US005097729A

United States Patent [19]

Brown

[11] Patent Number: 5,097,729

[45] Date of Patent: Mar. 24, 1992

[54] BOTTLE AND JAR CAP OPENER

[76] Inventor: Dwight C. Brown, 1516 N. Nicholas St., Arlington, Va. 22205

[21] Appl. No.: 676,114

[22] Filed: Mar. 27, 1991

[51] Int. Cl.[5] ..... B67B 7/18

[52] U.S. Cl. ..... 81/3.43; 81/64

[58] Field of Search ..... 81/3.43, 64, 302

[56] References Cited

U.S. PATENT DOCUMENTS

| | | | |
|---|---|---|---|
| 213,698 | 3/1879 | Sherwood | 81/64 |
| 893,405 | 7/1908 | Weisbeck | 81/3.43 |
| 1,155,288 | 9/1915 | Stark | 81/302 |
| 1,196,060 | 8/1916 | Wilson | 81/3.43 |
| 2,320,599 | 6/1943 | Hickman | 81/3.43 |
| 2,547,748 | 4/1951 | Freer | 81/3.43 |
| 3,084,573 | 4/1963 | Lipski | 81/3.43 |

*Primary Examiner*—Roscoe V. Parker
*Attorney, Agent, or Firm*—William L. Klima

[57] ABSTRACT

A device for removing caps from bottles, jars, etc. The device includes a pair of handles with a pivot therebetween and a gripping band connected to the handles for tightly gripping the cap to be removed. The handles include gripping portions to tightly grip the cap in combination with the gripping band. The device may be provided with an adjustable length gripping band in combination with a band locking retainer to accommodate various size caps.

19 Claims, 3 Drawing Sheets

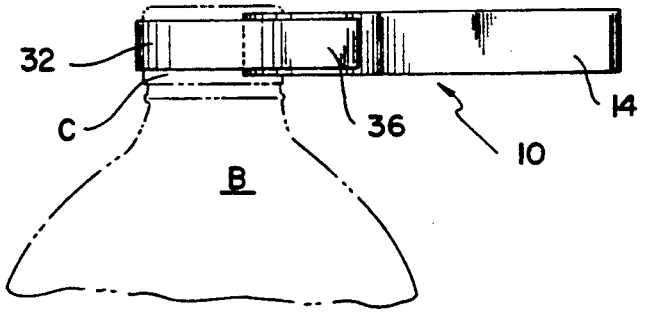
FIG. 10
FIG. 12A
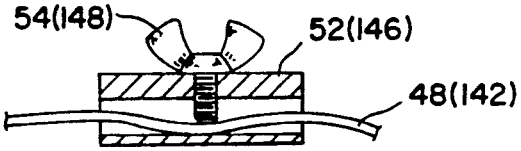
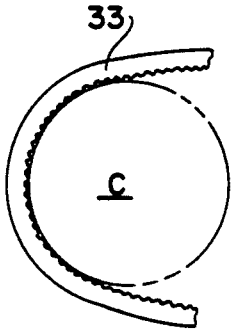
FIG. 11
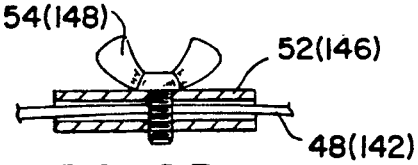
FIG. 12B
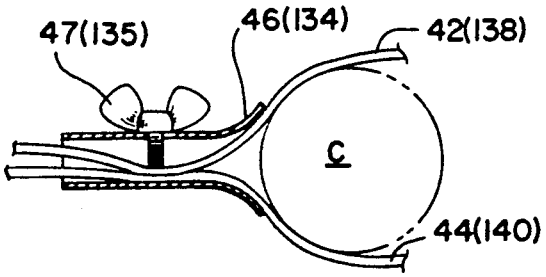
FIG. 12C
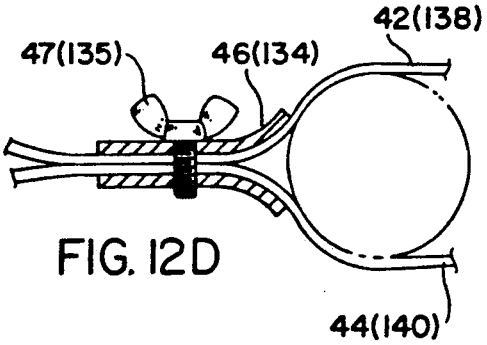
FIG. 12D
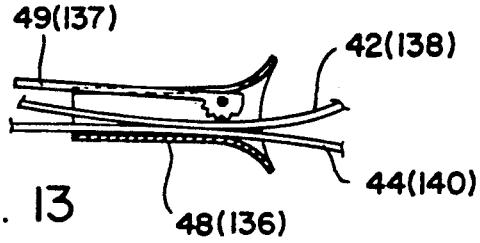
FIG. 13

BOTTLE AND JAR CAP OPENER

BACKGROUND OF THE INVENTION

1. Field of the Invention

This invention relates to a device for removing caps from bottles, jars, etc. The device includes a pair of handles with a pivot means therebetween and a band, which together with the handles tightly grip the cap and effect removal upon rotation of the device.

2. Prior Art

Many types of bottle and jar openers have been designed and constructed over the past 100 years. Some of these openers are based around a plier-type design including a strap or ring for tightening about the circumference of a cap to effect removal upon turning of the device.

Despite the vast number of bottle and jar openers of this type, they are rarely seen in stores and marketed by other methods in the United States. Thus, one could come to the conclusion that these prior art devices were ineffective, cumbersome to use and store, difficult to clean, too expensive to manufacture or failed to become successful for other reasons.

SUMMARY OF THE INVENTION

Accordingly, it is a primary object of this invention to provide a bottle and jar opener of an improved type that is compact, easy to use, easy to clean, inexpensive to manufacture and is highly effective in gripping and removing a cap.

Another object of the present invention is to provide a bottle and jar opener that comprises a pair of handles with a pivot means therebetween and a band connected to the handles, which together tightly grip the cap by the band and gripping portions of the handle upon gripping the handles together to effect removal of the cap upon rotation of the opener.

A further object of the present invention is to provide a bottle and jar opener having a pair of handles with a pivot means therebetween and an adjustable length band connected to the handles to accommodate different sizes of caps.

These and other objects of the present invention are accomplished by providing a cap opener comprising a pair of handles with a pivot means therebetween, and a band connected to the handles. The pivot means can take various forms such as a set of gear-like teeth on one handle meshing together with another set of teeth on the other handle. Alternatively, the pivot means can be defined by a pin retained within a set of holes in the handles.

The band should be made of material or constructed in a manner to effectively grip the cap and preferably should have minor vertical serrations on the inside surface of the band to increase the friction gripping of the band. Further, the gripping portions of the handles should be made of material or constructed in a manner to effectively grip the cap.

Further, the band can be of a fixed length and securely connected at its ends to each handle, or the band may be molded as an integral part of the handles. Alternatively, the opener can be made so that the band is adjustable in its effective length to accommodate different sizes of caps.

The adjustable band may have spaced apart holes in the center, and one end permanently attached to one handle, with the other loose end secured at the desired length by providing projection pins or knobs on the exterior surface of the other handle. Also, the loose end of the band may be secured at the desired length by use of a separate locking retainer provided on one handle in lieu of the referenced projections or knobs. In addition, the band may be constructed without holes with one end permanently affixed to one handle and the other loose end secured at the desired length by a locking retainer located on the other handle.

BRIEF DESCRIPTION OF THE DRAWINGS

Referring to the drawings, wherein like references characters refer to like parts throughout the several views, and wherein:

FIG. 10 is a side view of the opener 10 shown in FIG. 1;

FIG. 11 is a top view of a band having serrations;

FIG. 12A is a detailed side cross-sectional view of the wing headed bolt type retainer utilized in the embodiments shown in FIGS. 5 and 9;

FIG. 12B is a detailed side cross-sectional view of another embodiment of the wing headed bolt type retainer shown in FIG. 12A;

FIG. 12C is a detailed cross-sectional view of a wing headed bolt type retainer similar to the type utilized in the embodiments shown in FIGS. 3A and 7A except using bands without spaced apart holes;

FIG. 12D is a detailed cross-sectional view of a wing headed bolt type retainer utilized in the embodiments shown in FIGS. 3A and 7A; and FIG. 13 is a cross-sectional view of the lever type retainer for use with bands having no holes utilized in the embodiments shown in FIGS. 3A and 7B.

DETAILED DESCRIPTION OF PREFERRED EMBODIMENTS

Figure 1A:
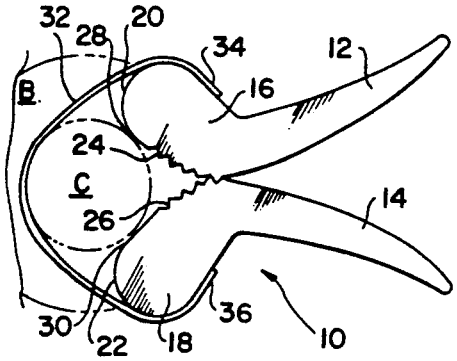
FIG. 1A is a top view of one embodiment of the bottle and cap opener according to the present invention having a nonadjustable gripping band without holes mounted on a cap ready for removal.
Figure 1B:
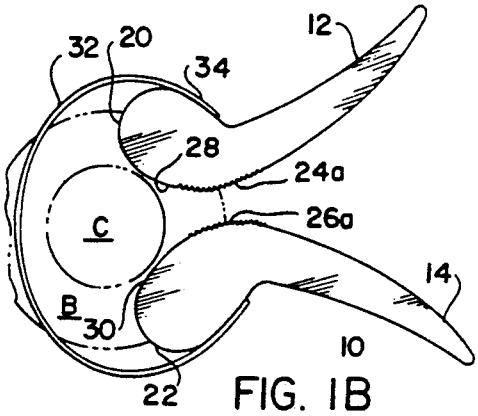
FIG. 1B is a top view of a slightly different embodiment of the bottle and cap opener according to the present invention mounted on a cap ready for removal.

One embodiment of the bottle and jar opening device 10 according to the present invention is shown in FIG. 1 positioned about a cap C about to be removed from a bottle B. The device 10 includes a first handle 12 and a second handle 14, which can be described as a pair of handles. The handles can be identical in material and/or construction to simplify fabrication and cost of construction. However, the exact design and shape of each handle may vary to provide different leverage arrangements, comfort factor of the user's hand interfacing with the device and other ergonomic factors. For example, the handles 12,14 shown in FIG. 1 are curved in shape for comfort and for purposes relating to the pivot means to be described below.

The handle 12 is provided with a cam lobe 16 and the handle 14 is provided with a cam lobe 18. The cam lobes 16,18 are provided with camming surfaces 20,22, respectively, and can be defined as portions of the handles 12,14, or can be considered as separate projections extending from the handles 12,14. In either event, the lobes must extend a distance outwardly from the lengthwise axis of each handle in order to provide a camming function wherein the distance between the camming surfaces 20,22 is increased as the handles 12,14 are gripped together, for example, by a user's hand. The significance of increasing the distance between the gripping surfaces 20,22 with relation to the gripping action of the device will be described below. Further, the shape of the lobes and the angle of the lobes relative to the lengthwise axis of the handle can be varied to maximize the gripping force for a particular size cap.

The device 10 is provided with a pivot means for providing a pivot point between the pair of handles 12,14. In this embodiment, the pivot means is defined by a set of gear teeth 24 on cam lobe 16 (or handle 12) meshing with a set of gear teeth 26 on the cam lobe 14 (or handle 14). This arrangement provides a pivot point that travels, from a left portion of the sets of gear teeth 24,26 to a right portion viewing FIG. 1, as the handles 12,14 are gripped together. Alternatively, the sets of gear teeth 24,26 can be replaced with sets of serrations 24a,24b. In this embodiment, the opener 10 is shown in the open position prior to being gripped shut.

Portions of the cam lobes 16,18 can be defined as having gripping portions 28,30, respectively. These gripping portions 28,30 can simply be a portion of the surface of the cam lobes 16,18, or can be special or discrete zones or components located on the cam lobes 16,18. For example, the gripping portions can be a small strip of resilient rubber adhered to the outer surfaces of the camming lobes 16,18 to enhance the gripping effect of the cam lobes 16,18 or can be defined by serrations on the surfaces of the cam lobes 16, 18 at the cap gripping position of the cam lobes 16,18. As an example, the sets of gear teeth 24,26 can be extended to the gripping surface regions of the cam lobes to increase the gripping power of the cam lobes, especially for use with caps having small gear-like projections around the outer circumference thereof.

The sets of gear teeth 24,26 or sets of serrations also provide a mechanical advantage and act as a force multiplier with respect to the magnitude of gripping force that the gripping portions can exert on the cap during removal. More specifically, as the device is rotated and force by a user's hand is concentrated more on the handle being pushed by the palm, verses the one being gripped towards the pushing handle by the fingers, there is a tendency due to the gear effect of the teeth or serrations to further tighten the device due to the resistance force applied from the cap to the device causing an equal and opposite greater force being applied to the pushing handle. Thus, the device has a self-tightening effect during the removal operation. However, the self-tightening effect does not reach the stage where the device becomes strongly clamped to the cap and difficult to remove like a Vise-grip pliers. This is again due to the gear-type pivot wherein there exists a mechanical advantage by the gear sets in the opposite handle opening operation.

The device 10 is provided with a strap or band 32 having ends 34,36 that are secured to the handles 12,14 (or cam lobes 16,18). For example, a mechanical fastener such as a screw and/or adhesive or other means can be utilized to secure these ends to the device. Alternatively, where the band is of a definite length and non-adjustable, it may be molded as an integral part of the handle. The band 32 is preferably made of a particular material and is of a sufficient cross section to have enough tensile strength so as not to break after a single or repeated use. Preferably, the band is also made of a material and/or of a particular design to increase or maximize the gripping force applied by the band 32 on a cap to be removed such as the band 33 shown in FIG. 11 having serrations provided along its inner surface to facilitate gripping. Further, the band can be made of a plastic having a soft surface to increase the frictional resistance between the band and the cap, or can be provided with a soft gripping cover or sleeve. However, the band 32 can be made out of a low friction material with the device relying on the gripping ability of the gripping portions of the handles to effect cap removal.

The device shown in FIG. 1 is preferably made of any of a number of conventional structural plastics to minimize cost of manufacture. However, other materials such as white metal or aluminum could be substitute for the handle portions, and possibly even the band section (e.g. thin spring steel band).

Figure 2:
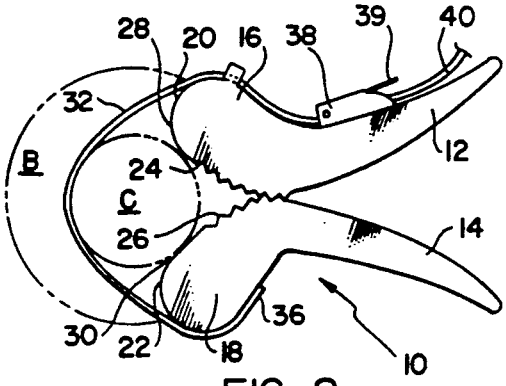
FIG. 2 is a top view of another embodiment of this same device equipped with a lever activated locking retainer provided on one handle to provide adjustment of the desired length of the gripping band without holes.

In order to accommodate different sized and/or shaped caps with the same basic device, the device can be provided with various band length adjusting devices, as shown in FIGS. 2-5, to vary or adjust the effective length of the band 32. In FIGS. 2 and 6B, the handle 12 is provided with a lever type retainer 38 having a lever 39 pivotably mounted within the retainer. The lever 39 is provided with teeth or a friction pad to lock the free end 40 of the band 32 at a particular position after adjusting the length of the band 32 (See FIG. 6B). In operation, the lever 39 is lifted upwardly to allow insertion of the free end 40 of the band between the lever 39 and a base portion of the retainer 38 followed by rotating the lever 39 downwardly until it locks into place so that the teeth tightly grip the band after adjustment of the length of the band. The retainer 38 is provided with means (not shown) for releasably locking the lever 39 in the gripping position, for example, a set of protrusions on the side of the lever interacting with a set of detents provided on the inside surfaces of the retainer.

Figure 3A:
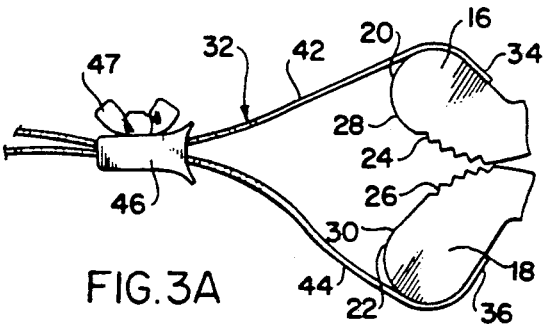
FIG. 3A is a partial top view of a further embodiment of this same device wherein the adjustable length band with or without holes is constructed in two sections, each end of which is permanently attached to the handles and the other loose ends secured at the desired length by use of a wing headed bolt locking retainer located at the rear of the cap to be removed.

Another version of an adjustable length band is shown in FIG. 3A and 12D. In this embodiment, the band 32 is constructed of two band sections 42,44 each having a plurality of holes therethrough. The band sections are passed through a locking retainer 46 having a wing headed bolt 47 securing the sections through a set of holes after adjustment of the combined length of the sections 42,44 of the band 32. A cross-sectional view of the retainer 46 is shown in FIG. 12D with the wing headed bolt 47 passing through the holes in both band sections 42,44 and through threaded holes in the retainer 46.

Figure 3B:
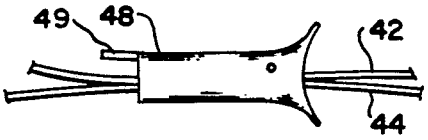
FIG. 3B is a side view of a belt-type retainer which may be used with bands having no holes in lieu of the wing headed bolt locking retainer shown in FIG. 3A.

Other securement devices can be substituted for the one shown. For example, the band sections 42,44 may be provided without holes and the wing headed bolt 47 passes through a single threaded hole in the retainer 46, as shown in FIG. 12C, with clamping of the band sections occurring between a base portion of the retainer and the bottom of the wing headed bolt. Alternatively, a lever type retainer 48 having a lever 49 as shown in FIGS. 3B and 13 can be substituted for either of the above-described versions of the wing headed bolt type retainer.

Figure 4:
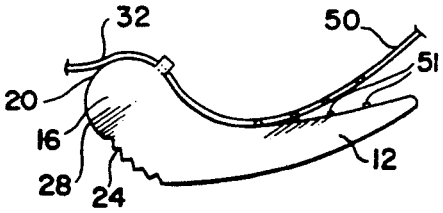
FIG. 4 is a partial top view of still a further embodiment of this same device with a band having a plurality of holes therethrough, which holes cooperate with one or more projection pins provided on one handle to allow adjustment of the effective length of the band.

A further version of an adjustable length band is shown in FIG. 4. In this embodiment, the band 32 is connected at one end to handle 14 (See FIG. 1A), and is provided with a plurality of holes at an opposite free end 50. The handle 12, in this embodiment, is provided with one or more pins 51 for engaging one or more holes in the band 32. The pins 51 can be slightly force fitted into the holes so that the band 32 is securely retained on the handle 12, however, this may not be necessary since the user's hand tends to maintain the band 32 in close contact with the handle 12 during operation. Alternatively, the pins 51 can be replaced with one or more hooks (e.g. L-shaped) for securing the band 32.

Figure 5:
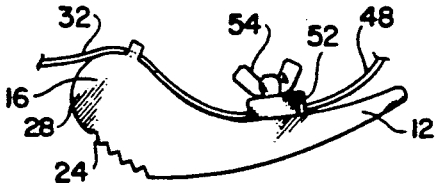
FIG. 5 is a partial top view of an even further embodiment of this same device with a retainer having a wing headed bolt provided on one handle for use with a band having spaced apart holes or a band without holes, one end of which is permanently attached to one handle and the other loose end adjusted to the desired length by use of a wing headed bolt locking retainer located on the other handle.

A still further version of an adjustable length band is shown in FIGS. 5 and 12A. In this embodiment, a retainer 52 having a wing headed bolt 54 is provided on the handle 12. The bolt can pass through a threaded hole in the retainer 52 and grip the band against a base portion of the retainer. Alternatively, the band can be provided with a plurality of holes and the wing headed bolt can pass through a hole and a pair of threaded holes in the retainer as shown in FIG. 12B.

Figure 6A:
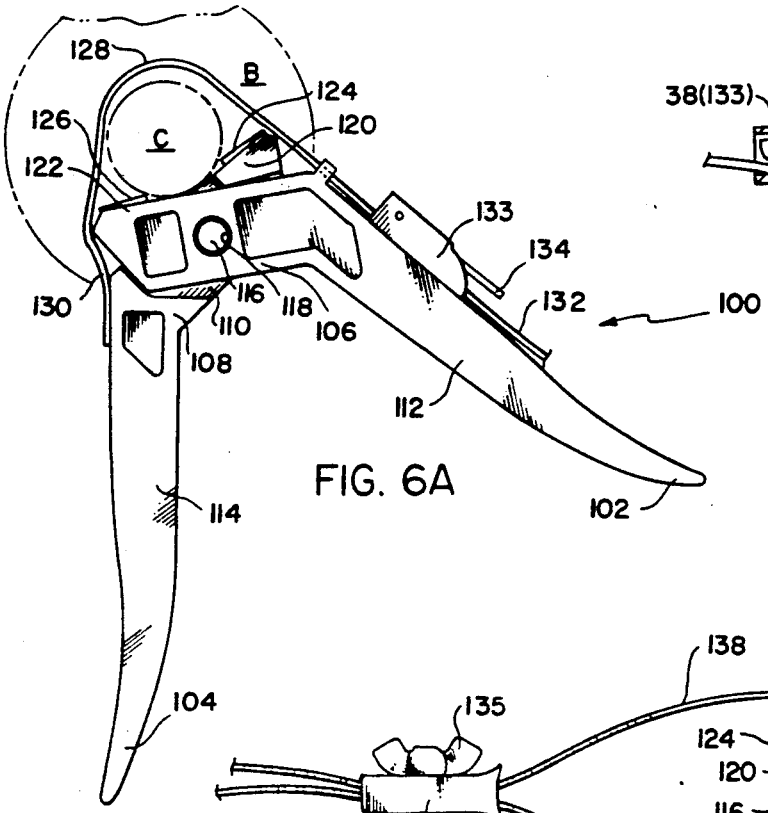
FIG. 6A is a top view of another embodiment of the bottle and jar opener having a pivot pin located in the handles and an adjacent band without holes, one end of which is permanently attached to one handle and the other loose end secured at the desired length by use of a lever type locking retainer.
Figure 6B:
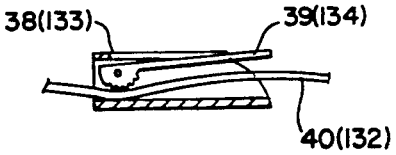
FIG. 6B is a detailed side cross-sectional view of the lever type locking retainer utilized in the embodiments shown in FIGS. 2 and 6A.

Another embodiment of the opening device 100 (shown in the open position) according to the present invention is shown in FIG. 6A. The device 100 comprises a first handle 102 and a second handle 104, which together can be defined as a pair of handles. The handle 102 includes a bent end section 106, and handle 104 includes a bent end section 108. These bent end sections 106,108 are set at a predetermined angle relative the lengthwise axis of each handle 102,104.

In the embodiment shown in FIG. 6A, the bent end sections are provided with channels 110 (hidden on bent end section 106) leaving a remaining portion of the bent end at the channel of approximately one-half (½) the thickness of the main portions 114,116 of the handles 102,104. The channel of one bent end section accepts the remaining portion of the other bent end section to form a plier-type handle of substantially constant thickness despite the pivot connection to be described below.

The handles 102,104 are pivotably connected together by a pin 116, which is retained within holes 118 passing through the bent end sections 106,108. The pin can be solid with crimped ends so that it is retained within the holes or can be two pieces (e.g. a pin and retainer). Alternatively, the pin may be incorporated as an integral part of the handle.

The bent end portions 106,108 are provided with gripping portions 120,122. In the embodiment shown in FIG. 6A, the gripping portions 120,122 are the full thickness of the main portions 112,114 of the handles 102,104, and define a side of the channels 110. However, the gripping portions can be constructed so as to be only a portion of this thickness. Further, the gripping portions 102,104 can be provided with friction pads 124,126, for example, made of rubber adhered within slight recesses in the gripping portions 102,104.

A band 128 is connected at one end 130 to handle 104 and includes a free end 132 passing through a lever type retainer 133 having a lever 134. The lever type retainer 133 is the same or similar to the retainer 38 shown in FIGS. 2 and 6B. Other versions of this embodiment are shown in FIGS. 7-9 to provide an adjustable length band.

Figure 7A:
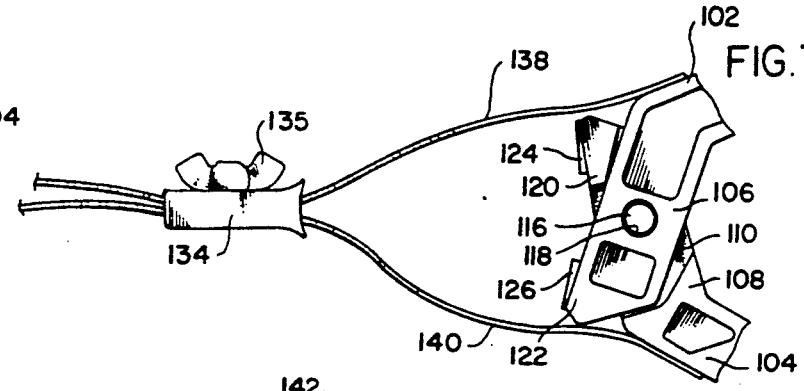
FIG. 7A is a partial top view of another embodiment of this same device wherein the adjustable length band with or without holes is constructed in two sections with one end of each section attached to the handles and the other loose ends secured at the desired length by a wing headed bolt locking retainer located at the rear of the cap to be removed.
Figure 7B:
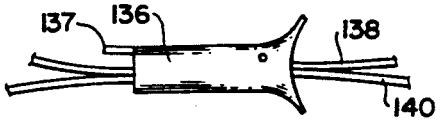
FIG. 7B is a side view of a lever type retaining device to be used with the embodiment of the device shown in FIG. 7A.

In FIGS. 7A and 12D, a retainer 134 having a wing headed bolt 135 the same or similar to the retainer 46 shown in FIG. 3A, is provided for securing the band sections 138,140. The opposite ends of the band sections are attached to the handles 102,104. Alternatively, a lever type retainer 136 having a lever 137, as shown in FIGS. 7B and 13, can be substituted for the retainer 134 shown in FIGS. 7A and 12D.

Figure 8:
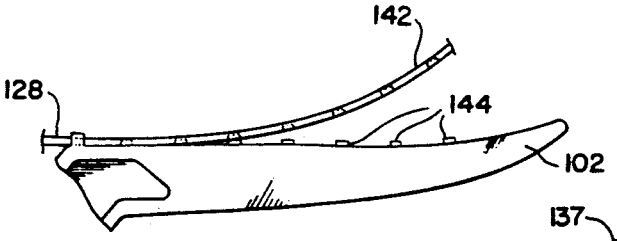
FIG. 8 is a partial top view of a further embodiment of this same device with a band having a plurality of holes therethrough, which holes cooperate with one or more projection pins provided on one handle to allow adjustment of the effective length of the band.

In FIG. 8, the band 128 includes a free end 142 having a plurality of holes for cooperating with one or more pins 144 extending from the handle 102 similar to the arrangement shown in FIG. 4.

Figure 9:
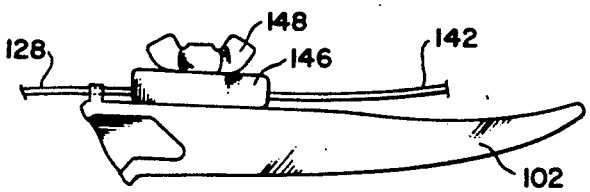
FIG. 9 is a partial top view of a still further embodiment of this same device with a retainer having a wing headed bolt provided on one handle for use with a band having spaced apart holes or a band without holes to allow adjustment of the length of the band.

In FIGS. 9 and 12A, the handle 102 is provided with a retainer 146 having a wing headed bolt 148, which grips the free end 142 of the band 128.

Any of the above-described adjustable length band arrangements and retaining devices can be utilizes with either of the basic embodiments of the devices shown in FIGS. 1A and 6A.

During operation with the embodiment of the cap opening device shown in FIG. 1A, the handles 12,14 are initially spread apart to provide sufficient slack in the band 32 to allow the device to be positioned around the cap C. More specifically, once the handles 12,14 are spread apart, the user places the band over the cap C and on one side thereof with the gripping portions 28,30 of the cam lobes 16,18 positioned on the opposite side. The user then grips the handles with one hand between the fingers and palm and squeezes the handles 12,14 together until an adequate gripping force is exerted on the cap C. The user then rotates the device, usually in the counter-clockwise direction, to effect loosening followed by removal of the cap.

In the versions of this embodiment shown in FIGS. 2-5, the effective length of the band 32 is adjusted by the various retainers until the band is somewhat tight about the cap. Then the above step to effect gripping, loosening and removal is performed.

During operation with the embodiment shown in FIG. 6, the handles 102,104 are spread apart to allow the band 128 to be slip over and around the cap C so that the cap is positioned between the band 128 and the gripping portions 120,122. The user then grips the handles together to tightly grip the cap to effect removal. The length of the band is adjusted in the versions of this embodiment shown in FIGS. 7-9 the same as that described above with respect to the versions of the embodiment shown in FIGS. 2-5.

I claim:

1. A bottle and jar cap opener, comprising:

a first handle having a free end and including a first cam lobe at an opposite end, said first cam lobe having a first outer camming surface and a first cap gripping portion;

a second handle having a free end and including a second cam lobe at an opposite end, said second cam lobe having a second outer camming surface and a second cap gripping portion;

pivot means between said first handle and said second handle for separating said first camming surface from said second camming surface upon gripping together said free ends of said handles; and a band of sufficient length to at least partially wrap around the cap to be opened, said band is connected to said handles in a manner so that said camming surfaces act upon an inner surface of said band, which draws the cap into contact with said gripping portions of said handles while shortening the effective length of said band upon gripping said handles together to tightly grip the cap between said band and said handles to effect removal of the cap upon rotation of the opener.

2. A bottle and jar cap opener according to claim 1, wherein said pivot means is defined by a first set of gear teeth provided on an inner surface of said first cam lobe intermeshing with a second set of gear teeth provided on an inner surface of said second cam lobe.

3. A bottle and jar cap opener according to claim 1, wherein said pivot means is defined by a first set of serrations provided on an inner surface of said first cam lobe intermeshing with a second set of gear teeth provided on an inner surface of said second cam lobe.

4. A bottle and jar cap opener according to claim 1, wherein said handles are curved.

5. A bottle and jar cap opener according to claim 2, wherein said handles are curved.

6. A bottle and jar cap opener, comprising:

a first handle having a first main portion extending a to a first bent end, said first bent end including a first cap gripping portion on an outer surface thereof;

a second handle having a second main portion extending to a second bent end, said second bent end including a second cap gripping portion on an outer surface thereof;

a band connected to said main portions of said handles and positioned around said cap gripping portions together defining a cap gripping arrangement, said band having a sufficient length to at least partially wrap around the circumference of the cap to be removed; and pivot means pivotally connecting said first bent end and said second bent end, said pivot means being located between the cap gripping portion and band connection on the main portion of each handle, wherein said pivot means provides pivoting between said handle when a user squeezes the handles together driving said gripping portions into contact with the cap while tightening said band against the circumference of the cap to be removed.

7. A bottle and jar cap opener according to claim 6, wherein said pivot means is defined by a pin retained within a set of holes in said bent ends.

8. A bottle and jar cap opener according to claim 7, wherein said bent ends include portions approximately one-half the thickness of said handles at said pin to provide a pivot of approximately the same thickness as said handles.

9. A bottle and jar cap opener according to claim 8, wherein said bent ends include projections in the direction of thickness at their ends to accommodate said gripping portions of approximately full thickness.

10. A bottle and jar opener according to claim 1, including means for adjusting the length of said band prior to use of the opener.

11. A bottle and jar opener according to claim 10, wherein said adjusting mean sis defined by a lever type retainer comprising a pivotable lever having band gripping teeth, said retainer can be opened to adjust the length of said band and closed to clamp the band with said teeth of said lever, said retainer being positioned on one of said handles.

12. A bottle and jar opener according to claim 10, wherein said adjusting means is defined by a wing headed type retainer that can be opened by unscrewing a wing headed bolt to allow adjustment of the length of the band and closed by screwing the wing headed bolt into the retainer to grip the band at a particular point, said retainer being positioned on one of said handles.

13. A bottle and jar opener according to claim 10, wherein said adjusting means is defined by a retainer that can be opened to adjust the length of a band made of two separate sections and closed to clamp the separate sections of the band together to fix the overall length of the band.

14. A bottle and jar opener according to claim 10, wherein said adjusting means is defined by said band being provided with plural holes at one end with at least one hole cooperating with at least one gripping projection provided on one of said handles.

15. A bottle and jar opener according to claim 6, including means for adjusting the length of said band prior to use of the opener.

16. A bottle and jar opener according to claim 15, wherein said adjusting means is defined by a lever type retainer that can be opened by a lever to adjust the length of said band and closed to clamp the band with teeth of said lever at a particular point, said retainer being positioned on one of said handles.

17. A bottle and jar opener according to claim 15, wherein said adjusting means is defined by a wing headed type retainer that can be opened by unscrewing a wing headed bolt to allow adjustment of the length of the band and closed by screwing the wing headed bolt into the retainer to grip the band at a particular point, said retainer being positioned on one of said handles.

18. A bottle and jar opener according to claim 15, wherein said adjusting means is defined by a retainer that can be opened to adjust the length of a band made of two separate sections and closed to clamp the separate sections of the band together to fix the overall length of the band.

19. A bottle and jar opener according to claim 15, wherein said adjusting means is defined by said band being provided with plural holes at one end with at least one hole cooperating with at least one gripping projection provided on one of said handles.

* * * * *